US007153446B2

(12) United States Patent
Grigg

(10) Patent No.: US 7,153,446 B2
(45) **Date of Patent: *Dec. 26, 2006**

(54) FIRE AND EXPLOSION SUPPRESSION

(75) Inventor: Julian Grigg, Burnham (GB)

(73) Assignee: Kidde IP Holdings Limited, Berkshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/473,549

(22) PCT Filed: Mar. 28, 2002

(86) PCT No.: PCT/GB02/01476

§ 371 (c)(1),
(2), (4) Date: Mar. 29, 2004

(87) PCT Pub. No.: WO02/078790

PCT Pub. Date: Oct. 10, 2002

(65) Prior Publication Data

US 2004/0144949 A1 Jul. 29, 2004

(30) Foreign Application Priority Data

Mar. 29, 2001 (GB) ..... 0107886.4
Jul. 27, 2001 (GB) ..... 0118374.8

(51) Int. Cl.
*A62D 1/02* (2006.01)
*A62C 35/62* (2006.01)

(52) U.S. Cl. ..... 252/3; 252/8; 169/9; 169/11; 169/14; 169/44

(58) Field of Classification Search ..... None
See application file for complete search history.

(56) References Cited

U.S. PATENT DOCUMENTS 3,666,864 A 5/1972 Terrell (Continued)

FOREIGN PATENT DOCUMENTS

EP 0 562 756 A1 9/1993

(Continued)

OTHER PUBLICATIONS

"Practical preparation of potentially anesthetic fluorinated ethyl methyl ethers by means of bromine trifluoride and other methods", Hudlicky et al., Journal of Fluorine Chemistry 102(2000) 363-367. XP-002215665.

*Primary Examiner*—Matthew A. Thexton
(74) *Attorney, Agent, or Firm*—Merchant & Gould P.C.

(57) ABSTRACT

A fire or explosion suppression system comprises a source (30) of a liquid suppressant under pressure, and a source (32) of an inert gas under pressure. The liquid suppressant is a chemical substance having a low environmental impact, with a short atmospheric lifetime of less than 30 days. The inert gas may be nitrogen, carbon dioxide, argon, neon or helium or mixtures of any two or more of them. The suppressant and the inert gas are fed under pressure to an output unit (34) comprising a mixing chamber in which the liquid and the gas impinge to produce a mist of the liquid suppressant of very small droplet size which is entrained in the pressurised gas together with vapour from the liquid, the so-entrained mist and vapour and the gas being discharged by a nozzle (44) into an area to be protected. The mist and vapour are therefore carried by the entraining and transporting high pressure gas into regions of the areas to be protected, enabling a total flooding capability. The inert gas also performs a fire or explosion suppressing capability.

30 Claims, 2 Drawing Sheets

U.S. PATENT DOCUMENTS

| | | | | |
|---|---|---|---|---|
| 3,897,502 | A | 7/1975 | Russell et al. | |
| 5,141,654 | A | 8/1992 | Fernandez | |
| 5,759,430 | A | 6/1998 | Tapscott et al. | |
| 5,799,735 | A | 9/1998 | Sundholm | |
| 5,845,716 | A * | 12/1998 | Birk | 169/85 |
| 5,887,662 | A | 3/1999 | Sundholm | |
| 6,346,203 | B1 | 2/2002 | Robin et al. | |
| 6,422,320 | B1 * | 7/2002 | Mather et al. | 169/88 |
| 2004/0163825 | A1 * | 8/2004 | Dunster et al. | 169/44 |

FOREIGN PATENT DOCUMENTS

| | | | |
|---|---|---|---|
| GB | 1051841 | | 12/1966 |
| GB | 1 306 734 | | 2/1973 |
| GB | 2 265 309 | A | 9/1993 |
| GB | 2 370 766 | A | 7/2002 |
| GB | 2 370 768 | A | 7/2002 |
| WO | WO 95/28204 | | 10/1995 |
| WO | WO 98/09686 | | 3/1998 |
| WO | WO 99/38573 | | 8/1999 |
| WO | WO 01/05468 | A2 | 1/2001 |

* cited by examiner

FIRE AND EXPLOSION SUPPRESSION

BACKGROUND OF THE INVENTION

1. Field of the Invention

The invention relates to fire and explosion suppression. Embodiments of the invention, to be described below by way of example only, use liquid suppressants in mist form. The suppressants used are intended to deal with the problems of ozone depletion and global warming.

2. Description of the Related Art

It is known (e.g. from GB-A-2 265 309) to extinguish fires or explosions by discharging a liquid chemical fire extinguishing substance in mist form in suspension in an inert gas. It is also known from WO-A-015468 to discharge a chemical fire extinguishing substance in liquid form by means of an inert gas.

BRIEF SUMMARY OF THE INVENTION

According to the invention, there is provided a fire or explosion suppression agent, having two suppressant parts, one comprising an explosion suppressing chemical substance which is substantially liquid at normal temperatures and pressures and the other comprising a fire or explosion suppressing inert gas; the chemical substance being dispersed as a suspension in the inert gas, the chemical substance when so disposed having low environmental impact, with a short atmospheric lifetime of less than 30 days; the chemical substance comprising one or more chemicals with the structure Z-R-X-Y, where the monovalent radical Z is a halogen atom taken from the group fluorine (—F) or bromine (—Br); where the divalent radical R is a perfluoro- or polyfluoro-alkylidene group of formula —$C_nH_pF_{2n-p}$ with n in the range 1–6 and p in the range 0–4; where the divalent radical X is selected from the group ether (—O—) trifluoromethylimino (—N($CF_3$)—), carbonyl (—CO—), or ethenyl (—CW═CH—) with W being either H or Br; and where the monovalent radical Y is selected from the group hydrogen (—H—), bromine (—Br—), alkyl of formula —$C_mH_{2m+1}$ with m in the range 1–4, or perfluoroalkyl of formula —$C_mF_{2m+1}$ with m in the range 1–4, or polyfluoroalkyl of formula —$C_mH_kF_{2m+1-k}$ with m in the range 1–4 and k in the range 1–2m; the agent including nothing else having any significant environmental impact and which has an atmospheric lifetime longer than 30 days.

According to the invention, there is also provided a method of suppressing a fire or explosion, in which a fire or explosion suppressing chemical substance which is in liquid form or substantially so at normal temperatures and pressures is dispersed as a suspension in a fire or explosion suppressing inert gas and discharged with the gas into an area to be protected; the chemical substance being dispersed as a suspension in the inert gas, the chemical substance when so disposed having low environmental impact, with a short atmospheric lifetime of less than 30 days; the chemical substance comprising one or more chemicals with the structure Z-R-X-Y where the monovalent radical Z is a halogen atom taken from the group fluorine (—F) or bromine (—Br); where the divalent radical R is a perfluoro- or polyfluoro-alkylidene group of formula —$C_nH_pF_{2n-p}$ with n in the range 1–6 and p in the range 0–4; where the divalent radical X is selected from the group ether (—O—) trifluoromethylimino (—N($CF_3$)—), carbonyl (—CO—), or ethenyl (—CW═CH—) with W being either H or Br; and where the monovalent radical Y is selected from the group hydrogen (—H—), bromine (—Br—), alkyl of formula —$C_mH_{2m+1}$ with m in the range 1–4, or perfluoroalkyl of formula —$C_mF_{2m+1}$ with m in the range 1–4, or polyfluoroalkyl of formula —$C_mH_kF_{2m+1-k}$ with m in the range 1–4 and k in the range 1–2m; the agent including nothing else having any significant environmental impact and which has an atmospheric lifetime longer than 30 days.

According to the invention, there is further provided a fire or explosion suppressant system, comprising a source of a fire or explosion suppressing chemical substance which is in liquid form or substantially so at normal temperatures and pressures, and a source of a pressurised fire or explosion suppressing inert gas, means for dispersing the chemical substance as a suspension in the pressurised gas, and discharge means for discharging the so-dispersed chemical substance and the pressurised gas into an area to be protected; the chemical substance being dispersed as a suspension in the inert gas, the chemical substance when so disposed having low environmental impact, with a short atmospheric lifetime of less than 30 days; the chemical substance comprising one or more chemicals with the structure Z-R-X-Y where the monovalent radical Z is a halogen atom taken from the group fluorine (—F) or bromine (—Br); where the divalent radical R is a perfluoro- or polyfluoro-alkylidene group of formula —$C_nH_pF_{2n-p}$ with n in the range 1–6 and p in the range 0–4; where the divalent radical X is selected from the group ether (—O—) trifluoromethylimino (—N($CF_3$)—), carbonyl (—CO—), or ethenyl (—CW═CH—) with W being either H or Br; and where the monovalent radical Y is selected from the group hydrogen (—H—), bromine (—Br—), alkyl of formula —$C_mH_{2m+1}$ with m in the range 1–4, or perfluoroalkyl of formula —$C_mF_{2m+1}$ with m in the range 1–4, or polyfluoroalkyl of formula —$C_mH_kF_{2m+1-k}$ with m in the range 1–4 and k in the range 1–2m; the agent including nothing else having any significant environmental impact and which has an atmospheric lifetime longer than 30 days.

BRIEF DESCRIPTION OF THE DRAWINGS

Fire and explosion suppression systems and methods according to the invention, employing mists, will now be described by way of example only, with reference to the accompanying diagrammatic drawings in which.

DETAILED DESCRIPTION OF EMBODIMENTS OF THE INVENTION

Figure 1:
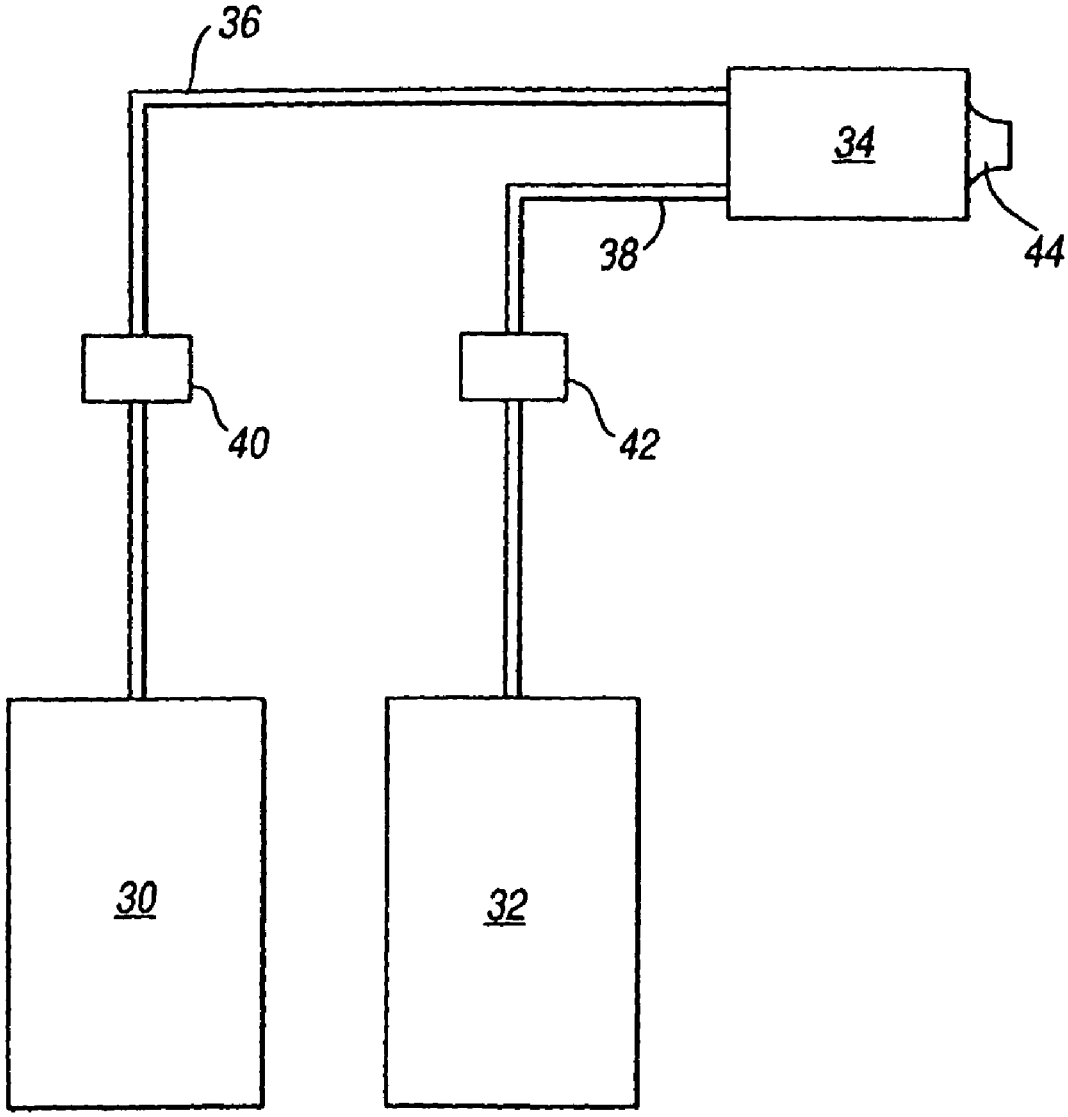
FIG. 1 is a schematic diagram of one of the systems.

Halons (Halons 1301 and 1211) have been used in the past as fire and explosion extinguishants and suppressants. Their physical and toxicological properties and extinguishing efficiency made them ideal for total flooding and streaming applications. They are efficient extinguishing agents because they contain bromine atoms which terminate the radical chain reactions that propagate combustion by catalytic reactions. These same bromine atoms are now known to catalytically remove ozone in the stratosphere. Therefore, Halons have an ozone depletion potential (ODP) and their production was ceased at the end of 1993. Since then, many alternative fire suppressants have reached the market place. Currently, hydrofluorocarbons dominate the industrial and commercial markets. However, aerospace, military and specialised uses are still dependent upon recycled Halon for space and weight efficiency reasons; the current Halon replacement agents are not as efficient as Halons for fire extinguishing.

Another factor that indicates the environmental impact of an extinguishing agent is its global warming potential (GWP). This parameter is related to the atmospheric lifetime of a molecule and is becoming increasingly important and will continue to do so in the future. This is especially true following the Kyoto Protocol and greenhouse gas emission targets. Hydrofluorocarbons have an ODP of zero but they have material atmospheric lifetimes. As a result, their use is likely to be subject to restriction in the future. Extinguishing agents with short atmospheric lifetimes are desirable.

There are several basic mechanisms for the breakdown of organic molecules released into the atmosphere:

1. Reaction with •OH radicals: this is the principal tropospheric degradation mechanism for most organic molecules. The most common reaction is that of hydrogen atom abstraction.

$$X—H+•OH \rightarrow •X+H_2O(slow)$$

$$•X \rightarrow \rightarrow \text{final products (fast)}$$

The rate of the whole process is controlled by the rate of the first reaction, the hydrogen abstraction reaction. The radical •X then breaks down very rapidly to the final products such as $CO_2$, $H_2O$, HF, HBr etc. which are washed out of the atmosphere in rain. Clearly the molecule must possess an abstractable hydrogen atom for this reaction to occur. There is also another possibility, namely addition of the •OH radical to a double bond, e.g.

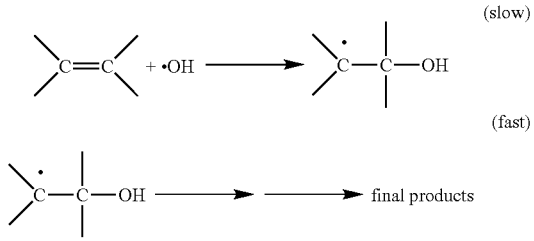

2. Hydrolysis: provided that the molecule contains hydrolytically unstable bonds, the reaction of a molecule with water generates water soluble molecules which are then rapidly washed out of the atmosphere in rain.
3. Photolysis: providing the molecule contains a UV-absorbing chromophore, such as a double bond, C═C or C═O, then degradation in the troposphere may occur readily.
4. Reaction with $O_3$ and $NO_3$: these two species contribute only a very minor part of the tropospheric degradation mechanisms in comparison with the •OH reaction route.

It is therefore possible to limit the atmospheric lifetime of gaseous extinguishing molecules by the introduction of substituents into the molecule that will yield a high rate of reaction with •OH radicals or substituents that will cause the molecule to decompose by photolysis in the troposphere. These molecules are said to be tropodegradable. Such substituents include the ether group (—O—), a carbonyl group (—CO—) and an alkene group (—C═C—). This strategy allows molecules that contain bromine to be used as extinguishing agents because the short atmospheric lifetimes mean that the agents do not get into the stratosphere where ozone depletion is a problem. However, the inclusion of these groups increases the molecular weight of the agent molecule. This increases the boiling point and gives the corresponding lowering of the vapour pressure. As a result, the tropodegradable extinguishing agents are likely to be liquids at room temperature and pressure.

Because total flooding applications require three dimensional distribution such as occurs with a gaseous agent, liquid extinguishing agents have not been considered in the past. Indeed, to a person skilled in the art of fire protection science, they would be dismissed from consideration because of these volatility issues.

Thus at present, suppressants that are essentially liquid at normal temperatures and pressures can be deployed for extinguishing fires using, for example, appliances such as hand-held fire extinguishers which deploy the suppressants in their normal form. They may be satisfactory in such applications but, because they are deployed in liquid form (e.g. as a liquid stream), they must be more or less directed at the fire for maximum effectiveness. They cannot be deployed in this way as a total flooding agent—that is, such as in gaseous or liquid form from which they will expand to fill a space in which a fire or explosion may exist or in which a fire or explosion is to be prevented. In many applications, such a total flooding capability is important in order to ensure that a specified space or volume (such as a room or the interior of a vehicle or a volume within an aircraft) can be more or less filled with the suppressant.

The systems and methods to be described are therefore essentially concerned with particular chemical suppressants which are in liquid form, or substantially so, at normal temperatures and pressures, and enable such suppressants, in spite of their liquid form, to be deployed as total flooding agents.

The chemical fire suppressants to be described have low environmental impact, with a short atmospheric lifetime of less than 30 days. More specifically, they comprise one or more chemicals with the structure Z-R-X-Y where the monovalent radical Z is a halogen atom taken from the group fluorine (—F), or bromine (—Br); where the divalent radical R is a perfluoro- or polyfluoro-alkylidene group of formula $—C_nH_pF_{2n-p}$ with n in the range 1–6 and p in the range 0–4; where the divalent radical X is selected from the group ether (—O—), trifluoromethylimino (—N(CF3)—), carbonyl (—CO—), or ethenyl (—CW═CH—) with W being either H or Br; where the monovalent radical Y is selected from the group hydrogen (—H), bromine (—Br), alkyl of formula $—C_mH_{2m+1}$ with m in the range 1–4, or perfluoroalkyl of formula $—C_mF_{2m+1}$ with m in the range 1–4, or polyfluoroalkyl of formula $—C_mH_kF_{2m+1-k}$ with m in the range 1–4 and k in the range 1–2m; and where, optionally, the radicals R and Y may be linked (by a C—C bond) such as to form a 4-, 5-, or 6-membered ring.

Preferably, the groups Z,X and Y are so selected that the total number of bromine atoms in the molecule does not exceed one.

Preferably, the groups R and Y are selected such that n+m lies in the range 1–6 with the further proviso that n−m must be at least 1.

Preferably, the groups R,X, and Y are chosen so that the total number of carbon atoms in the molecule is in the range 3–8, and very preferably in the range 3–6.

Preferably, the molecular weight of the molecule lies in the range 150–400, and very preferably in the range 150–350.

Preferably, the groups R,X and Y are chosen so the weight % of halogen (fluorine and bromine) in the molecule lies in the range 70–90%, and very preferably in the range 70–80%.

More specific examples of suitable suppressants are as shown in the Table on the following two pages. At the end of the Table, a list of three atmospheric degradation mechanisms is given, numbered 1 to 3. Using these numbers, the penultimate column of the Table indicates the particular degradation mechanism relevant to each agent.

| Extinguishing Agent | Formula | Mwt | Halogen (%) | Boiling Point at 1 atmosphere (° C.) | n-Heptane Cupburner Extinguishing Concentration (volume %) | Mechanism of Degradation (see note at end of Table) | Estimated Atmospheric Lifetime (days) |
|---|---|---|---|---|---|---|---|
| 2-bromo-1,1,2-trifluoro-1-methoxyethane | $CH_3OCF_2CHFBr$ | 193 | 71 | 89 | 4.2 ± 0.6 (estimated) | 1 | 14 |
| 2-bromo-1,1,2,2-tetrafluoro-1-methoxyethane | $CH_3OCF_2CF_2Br$ | 211 | 74 | 80–90 | ~4.0–4.5 | 1 | 14 |
| 2-bromo-1',1',1',2,2-pentafluoro-1-methoxyethane | $CF_3OCH_2CF_2Br$ | 229 | 76 | | ~4 | 1 | <20 |
| 2-bromo-2,3,3-trifluoro-1-oxacyclopentane | $[—CH_2CF_2CFBrCH_2—]O$ | 205 | 67 | | 4–5 | 1 | <20 |
| 2-(N,N-bis(trifluoromethyl)amino)-1,1-difluoro-1-bromoethane | $(CF_3)_2NCH_2CF_2Br$ | 296 | 78 | 80 | ~4 | 1 | <20 |
| 2-(N,N-bis(trifluoromethyl)amino)-1,1,2-trifluoro-1-bromoethane | $(CF_3)_2NCHFCF_2Br$ | 314 | 80 | 62 | ~4 | 1 | <20 |
| 2-(N,N-bis(trifluoromethyl)amino)-1,2-difluoro-1-bromoethane | $(CF_3)_2NCHFCHFBr$ | 296 | 78 | 76 | ~4 | 1 | <20 |
| 2-(N,N-bis(trifluoromethyl)amino)-1-bromoethane | $(CF_3)_2NCH_2CH_2Br$ | 260 | 75 | 90 | ~5 | 1 | <20 |
| 2-bromo-3,3,3-trifluoro-1-propene | $CH_2{=}CBrCF_3$ | 175 | 78 | 34 | 4.7 ± 0.2 | 2 | 3 |
| 4-bromo-3,3,4,4-tetrafluoro-1-butene | $CH_2{=}CHCF_2CF_2Br$ | 207 | 75 | 65 | 5.0 ± 0.3 | 2 | 7 |
| 2-bromo-3,3,4,4,4-pentafluoro-1-butene | $CH_2{=}CBrCF_2CF_3$ | 225 | 78 | 59 | 3.8 | 2 | 3 |
| 1-bromo-3,3,4,4,4-pentafluoro-1-butene | $CHBr{=}CHCF_2CF_3$ | 225 | 78 | 58 | 3.1 | 2 | <10 |
| 1-bromo-3,3,3-trifluoro-1-propene | $CHBr{=}CHCF_3$ | 175 | 78 | 40 | 3.5 | 2 | <10 |
| 2-bromo-3,3,4,4,5,5,5-heptafluoro-1-pentene | $CH_2{=}CBrCF_2CF_2CF_3$ | 275 | 77 | 78 | 3.7 | 2 | <10 |
| 2-bromo-3,4,4,4,4',4',4'-heptafluoro-3-methyl-1-butene | $CH_2{=}CBrCF(CF_3)_2$ | 275 | 77 | 79 | 3.3 | 2 | <10 |
| Dodecafluoro-2-methylpentan-3-one | $CF_3CF_2C(O)CF(CF_3)_2$ | 316 | 72 | 48 | 4.5 ± 0.1 | 3 | 5 |

Key to atmospheric degradation mechanism
1. tropodegradable due to reaction of —OH with $—OCH_3$, $—OCH_2—$, or $—NCH_2—$ or —NCHF— groups
2. tropodegradable due to reaction of —C=C— group with —OH
3. tropodegradable due to photolysis of CO group FIG. 1 shows how such a liquid suppressant may be deployed in mist form. As shown in FIG. 1, the liquid suppressant is stored under pressure in a suitable vessel 30. An inert gas, typically nitrogen, is stored under pressure in a second vessel 32. The vessels 30 and 32 are respectively connected to an output unit 34 by pipes 36 and 38 and control valves 40 and 42. When the control valves 40 and 42 are opened, the liquid suppressant and the inert gas are fed under pressure to the output unit 34. The output unit 34 comprises a hollow chamber into which the liquid suppressant and the inert gas are discharged. Within the mixing chamber, the gas and the liquid physically interact and the gas causes the suppressant to be formed into a mist made up of droplets of small size, preferably in the range of between 5 and 60 micrometres. The mist is produced partly by a shearing action of the gas on the liquid suppressant. Within the unit 34, the liquid suppressant may enter in a direction substantially parallel to the direction of the gas. Instead, it can enter substantially at right angles to the gas and the shearing action will be greater. Another possibility is for the liquid suppressant to enter in a direction opposite to that of the gas, and the shearing action may be greater still. After the liquid agent and inert gas have been mixed, vapour from the liquid agent will also be formed. The resultant vapour and mist of the liquid suppressant together with the inert gas, which carries them, exits through a nozzle 44 into the volume or area to be protected.

The combination of vapour and liquid mist dispersed in the inert gas now forms a suppression agent having some of the characteristics of a gaseous suppressant. In particular, because the vapour and mist are being carried by the inert gas they can permeate and expand into all or most parts of the space or volume to be protected and thus provide a total flooding capability. The suppressant agent of course includes nothing else having any significant environmental impact and which has an atmospheric lifetime longer than 30 days.

The output unit 34 may be arranged to supply more than one nozzle 44. More particularly, it may supply a pipework array with multiple nozzles.

Figure 2:
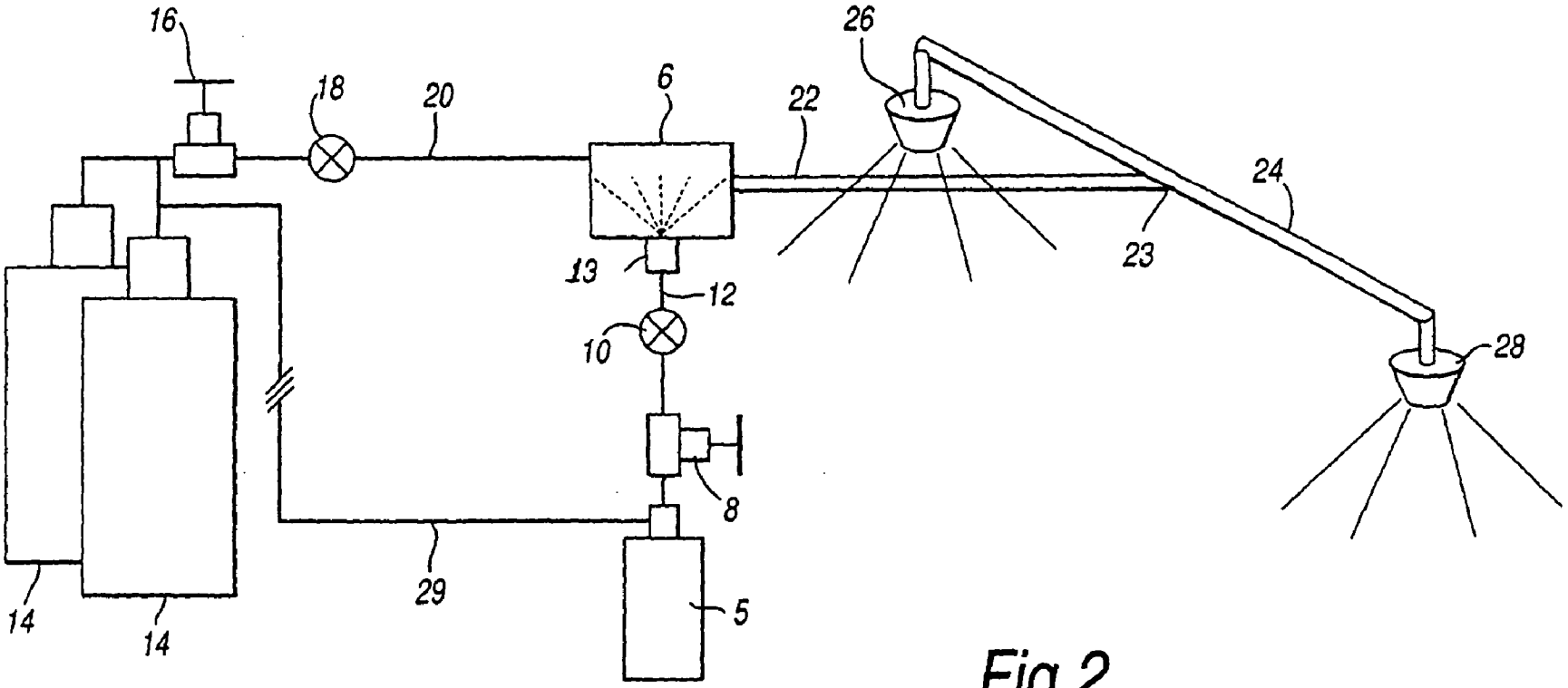
FIG. 2 is a schematic diagram of another of the systems.

FIG. 2 shows another system for deploying such a liquid suppressant in mist form and carried by an inert gas.

In FIG. 2, a vessel 5 stores the liquid suppressant under pressure. The vessel 5 is connected to an input of a mixing unit 6 via a pressure regulator 8, a flow regulator 10, a pipe 12, and a nozzle 13.

The system also includes vessels 14 storing an inert gas such as nitrogen which has an outlet connected via a pressure regulator 16, a flow regulator 18 and a pipe 20 to another input of the mixing unit 6. The mixing unit 6 has an outlet pipe 22 which connects with the distribution pipe 24 terminating in spreader or distribution heads 26, 28. The liquid suppressant in the vessel 5 may be pressurised by the gas in the vessels 14 via a pipe 29. However, it may be pressurised in some other way.

In use, the liquid suppressant from the vessel 5 is fed under pressure into the mixing unit 6 and enters the mixing unit 6 via the nozzle 13 which is arranged to convert the liquid suppressant into a mist of droplets of small size, again preferably in the range of between 5 and 60 micrometers. The mist may be produced simply by the step of forcing the liquid through the nozzle 13. Instead, the nozzle may incorporate means such as a rotary atomising disk to produce or augment the misting process.

Additionally, the mist of the liquid suppressant is mixed within the mixing chamber 6 with inert gas and becomes disposed as a suspension within the gas. Vapour is also formed as the liquid droplets evaporate by virtue of their high surface area to volume ratio.

The mist and vapour carried by the inert gas exit the mixing chamber 6 along the outlet pipe 22 to a T-junction 23 and thence along the distribution pipe 24, and exit from the spreaders 26, 28 into the volume to be protected.

In the system of FIG. 2, it is an important feature that the mixing unit 6 in which the mist is produced is separate from and distanced from the outlets or spreaders 26, 28. The mist and vapour exiting the mixing unit 6 moves at high velocity and is entrained by and within the high pressure gas. The resultant turbulence in the pipe 22 helps to reduce the size of the droplets in the mist and form vapour. The already-formed high velocity mist and vapour exit the spreaders as a two-phase mixture which consists of the inert gas carrying fine droplets and vapour of the liquid chemical extinguishant. The gas continues to expand, on exiting the spreaders 26, 28, producing an even mixture—which thus acts again as a total flooding agent.

The presence of the inert gas in the discharged mist increases the efficiency of the extinguishing and suppression action because the inert gas is a suppressant in its own right.

The systems described above with reference to FIGS. 1 and 2 have used nitrogen as the inert gas. Other suitable gases are argon, helium, neon and carbon dioxide or mixtures from any two or more of these gases and nitrogen. However, any other suitable gas or gas mixture may be used which is non-combustible or is effectively inert in a flame.

The extinguishants can have the advantage of being clean agents in that they leave no residue after deployment.

A mixture of the suppressants can be used.

Such systems as described with reference to FIGS. 1 and 2 can have fire suppressant properties similar or equivalent to those which use known total flooding extinguishing agents. They may have applications as an alternative to fixed fire suppression systems using Halons, perfluorocarbons, hydrofluorocarbons and hydrochlorofluorocarbons.

The invention claimed is:

1. A method of suppressing a fire or explosion, in which a fire or explosion suppressing chemical substance which is in liquid form or substantially so at normal temperatures and pressures is dispersed as a suspension in a fire or explosion suppressing gas and discharged with the gas into an area to be protected, comprising:

producing a mist of the chemical substance and entraining the mist in the gas, the production of the mist and the entrainment of the mist in the gas taking place before the discharge of the suspension into the area to be protected; and said discharge comprising discharging said suspension into an area to be protected; the chemical substance comprising one or more chemicals of the structure Z-R-X-Y, where the monovalent radical Z is a halogen atom taken from the group fluorine (—F) or bromine (—Br); where the divalent radical R is a perfluoro- or polyfluoro-alkylidene group of formula —$C_nH_pF_{2n-p}$—, with n in the range 1 to 6, and p in the range 0 to 4; where the divalent X is either an enther linkage, —O—, or an alkenic linkage, —CW═CH—, with W being either hydrogen (—H) or bromine (—Br); and where the monovalent radical Y is selected from the group hydrogen (—H), bromine (—Br), or alkyl of formula —$C_mH_{2m+1}$ with m in the range 1–4 or perfluoroalkyl of formula —$C_mF_{2m+1}$ with m in the range 1–4 or polyfluoro-alkyl group of formula —$C_mH_kF_{2m+1-k}$ where m is in the range 1–4 and k is in the range 1 to 2m; and with the provisos that (i) there is always one, and only one, bromine atom in the chemical Z-R-X-Y, and that (ii) the total number of carbon atoms in the chemical Z-R-X-Y is in the range 3–6; and the chemical substance having an atmospheric lifetime of less than 30 days.

2. A method according to claim 1, where the monovalent radical Z is a bromine atom (—Br); where n is in the range 2 to 3; where the divalent radical X is an ether linkage —O—; and where the monovalent radical Y is the alkyl or polyfluoro-alkyl group of formula —$C_mH_kF_{2m+1-k}$ where m is in the range 1 to 2 and k is in the range 1 to 2m+1; and with the proviso that the total number of carbon atoms in the molecule, n+m+2, is in the range 3–5.

3. A method according to claim 1, in which the molecular weight of the chemical Z-R-X-Y lies in the range 150–400.

4. A method according to claim 1, in which the groups R, X and Y are chosen so that the weight % of halogen (fluorine and bromine) in the chemical Z-R-X-Y lies in the range 70–90%.

5. A method according to claim 1, in which the chemical substance comprises 2-bromo-1,1,2-trifluoro-1-methoxyethane.

6. A method according to claim 1, in which the chemical substance is 2-bromo-1,1,2,2tetrafluoro-1-methoxyethane.

7. A method according to claim 1, in which the chemical substance is 2-bromo-1',1',1',2,2-pentafluoro-1-methoxyethane.

8. A method according to claim 1, in which the chemical substance is 2-bromo3,3,3-trifluoro-1-propene.

9. A method according to claim 1, in which the chemical substance is 4-bromo-3,3,4,4-tetrafluoro-1-butene.

10. A method according to claim 1, in which the chemical substance is 2-bromo-3,3,4,4,4-pentafluoro-1-butene.

11. A method according to claim 1, in which the chemical substance is 1-bromo-3,3,4,4,4-pentafluoro-1-butene.

12. A method according to claim 1, in which the chemical substance is 1-bromo-3,3,3,-trifluoro-1-propene.

13. A method according to claim 1, in which the chemical substance is 2-bromo-3,3,4,4,5,5,5-heptafluoro-1-pentene.

14. A method according to claim 1, in which the chemical substance is 2-bromo-3,4,4,4,4',4',4'-heptafluoro-3-methyl-1-butene.

15. A method according to claim 1, in which the gas comprises one or more of argon, helium, neon, nitrogen and carbon dioxide.

16. A fire or explosion suppressant system, comprising:

a source of a fire or explosion suppressing chemical substance which is in liquid form or substantially so at normal temperatures and pressures, a source of a pressurized fire or explosion suppressing gas, a disperser for dispersing the chemical substance as a suspension in the pressurized gas, the disperser being adapted for producing a mist of the chemical substance and entraining the mist in the gas, and a discharger for discharging the suspension into an area to be protected;

the chemical substance comprising one or more chemicals of the structure Z-R-X-Y, where the monovalent radical Z is a halogen atom taken from the group fluorine (—F) or bromine (—Br); where the divalent radical R is a perfluoro- or polyfluoro-alkylidene group of formula —$C_nH_pF_{2n-p}$—, with n in the range 1 to 6, and p in the range 0 to 4; where the divalent radical X is either an ether linkage, —O—, or an alkenic linkage, —CW═CH—, with W being either hydrogen (—H) or bromine (—Br); and where the monovalent radical Y is selected from the group hydrogen (—H), bromine (—Br), or alkyl of formula —$C_mH_{2m+1}$ with m in the range 1–4 or perfluoroalkyl of formula —$C_mF_{2m+1}$ with m in the range 1–4 or polyfluoro-alkyl group of formula —$C_mH_kF_{2m+1-k}$ where m is in the range 1 to 4 and k is in the range 1 to 2m; and with the provisos that (i) there is always one, and only one, bromine atom in the chemical Z-R-X-Y and that (ii); the total number of carbon atoms in the chemical Z-R-X-Y is in the range 3–6, and the chemical substance having an atmospheric lifetime of less than 30 days.

17. A system according to claim 16, where the monovalent radical Z is a bromine atom (—Br); where n is in the range 2 to 3; where the divalent radical X is an ether linkage —O—; and where the monovalent radical Y is the alkyl or polyfluoro-alkyl group of formula —$C_mH_kF_{2m+1-k}$ where m is in the range 1 to 2 and k is in the range 1 to 2m+1; and with the proviso that the total number of carbon atoms in the molecule, n+m+2, is in the range 3–5.

18. A system according to claim 16, in which the molecular weight of the chemical Z-R-X-Y lies in the range 150–400.

19. A system according to claim 16, in which the groups R, X and Y are chosen so that the weight % of halogen (fluorine and bromine) in the chemical Z-R-X-Y lies in the range 70–90%.

20. A system according to claim 16, in which the chemical substance comprises 2-bromo-1,1,2-trifluoro-1-methoxyethane.

21. A system according to claim 16, in which the chemical substance is 2-bromo-1,1,2,2-tetrafluoro-1-methoxyethane.

22. A system according to claim 16, in which the chemical substance is 2-bromo-1',1',1',2,2-pentafluoro-1-methoxyethane.

23. A system according to claim 16, in which the chemical substance is 2-bromo-3,3,3-trifluoro-1-propene.

24. A system according to claim 16, in which the chemical substance is 4-bromo-3,3,4,4-tetrafluoro-1-butene.

25. A system according to claim 16, in which the chemical substance is 2-bromo-3,3,4,4,4-pentafluoro-1-butene.

26. A system according to claim 16, in which the chemical substance is 1-bromo-3,3,4,4,4-pentafluoro-1-butene.

27. A system according to claim 16, in which the chemical substance is 1-bromo-3,3,3,-trifluoro-1-propene.

28. A system according to claim 16, in which the chemical substance is 2-bromo-3,3,4,4,5,5,5-heptafluoro-1-pentene.

29. A system according to claim 16, in which the chemical substance is 2-bromo-3,4,4,4,4',4',4'-heptafluoro-3-methyl-1-butene.

30. A system according to claim 16, in which the gas comprises one or more of argon, helium, neon, nitrogen and carbon dioxide.

* * * * *